US009221523B2

(12) United States Patent
Bauduin et al.

(10) Patent No.: US 9,221,523 B2
(45) Date of Patent: Dec. 29, 2015

(54) DISCONNECTABLE TURRET MOORING SYSTEM

(75) Inventors: Christian Raymond Bauduin, Eze (FR); Jean-Yves Silvain Toggiani, Roquebrune Cap Martin (FR)

(73) Assignee: SINGLE BUOY MOORINGS INC., Marly (CH)

( * ) Notice: Subject to any disclaimer, the term of this patent is extended or adjusted under 35 U.S.C. 154(b) by 183 days.

(21) Appl. No.: 13/823,251

(22) PCT Filed: Sep. 16, 2011

(86) PCT No.: PCT/EP2011/066144

§ 371 (c)(1),
(2), (4) Date: Apr. 10, 2013

(87) PCT Pub. No.: WO2012/035154

PCT Pub. Date: Mar. 22, 2012

(65) Prior Publication Data

US 2013/0213290 A1 Aug. 22, 2013

(30) Foreign Application Priority Data

Sep. 16, 2010 (EP) ..... 10177078

(51) Int. Cl.
*B63B 21/00* (2006.01)
*B63B 21/50* (2006.01)
*B63B 22/02* (2006.01)

(52) U.S. Cl.
CPC ..... *B63B 21/507* (2013.01); *B63B 22/026* (2013.01)

(58) Field of Classification Search
CPC .. B63B 21/507; B63B 21/508; B63B 22/026; B63B 22/023; B63B 21/50
USPC ..... 114/230.12
See application file for complete search history.

(56) References Cited

U.S. PATENT DOCUMENTS

| | | | | |
|---|---|---|---|---|
| 5,380,229 | A | 1/1995 | Korsgaard | |
| 5,529,521 | A | 6/1996 | Breivik et al. | |
| 5,651,708 | A | 7/1997 | Borseth | |
| 7,510,452 | B2 * | 3/2009 | Van Tol et al. | 441/5 |
| 2007/0155259 | A1 | 7/2007 | Van Tol et al. | |
| 2008/0166936 | A1 | 7/2008 | Lindblade | |

FOREIGN PATENT DOCUMENTS

| | | | |
|---|---|---|---|
| WO | 01/89919 | A1 | 11/2001 |
| WO | 2007/077126 | A1 | 7/2007 |
| WO | 2009/141351 | A2 | 11/2009 |

OTHER PUBLICATIONS

International Search Report, dated Jan. 16, 2012, from corresponding PCT application.

* cited by examiner

*Primary Examiner* — Samuel Morano
*Assistant Examiner* — Anthony Wiest
(74) *Attorney, Agent, or Firm* — Young & Thompson

(57) ABSTRACT

A disconnectable turret mooring system includes a mooring buoy, a turret structure, and a buoy locking system for locking the mooring buoy to the turret structure, whereby the turret structure includes an intermediate connection member, which includes the buoy locking system, wherein the intermediate connection member is rotatably supported by the turret structure. A method of mooring a vessel includes a turret structure to a mooring buoy, whereby the turret structure is arranged to receive the mooring buoy. The turret mooring system includes a turret structure that is rotatably supported by the vessel and an intermediate connection member that is rotatably supported by the turret structure. The method includes: receiving the mooring buoy into the turret structure, locking the mooring buoy to the intermediate connection member, and rotating the intermediate connection member and the turret structure with respect to each other.

16 Claims, 3 Drawing Sheets

DISCONNECTABLE TURRET MOORING SYSTEM

FIELD OF THE INVENTION

The present invention relates to a turret structure for a disconnectable turret mooring system, a disconnectable turret mooring system, a vessel comprising the turret structure and a method of mooring the vessel using the disconnectable turret mooring system.

BACKGROUND OF THE INVENTION

Disconnectable turret mooring systems are known from the prior art, for instance from WO2007/077126.

Disconnectable turret mooring systems comprising a mooring buoy and a turret structure. The mooring buoy is anchored to the seabed with anchoring legs. The turret structure, provided on a vessel, has a receptacle for receiving the buoy member and one or more buoy locking devices for locking the buoy member in the receptacle.

The turret structure may be an internal turret structure or an external turret structure. An internal turret structure is provided inside the hull of the vessel, in a so-called moonpool of the vessel. The receptacle is formed as an opening at or near the bottom of the vessel, facing downwards. An external turret structure is provided outside the hull of the vessel. The external turret is fixed with suitable connection members to the bow or stern of the vessel.

The mooring buoy may be moved up and down, i.e. from a temporary storage position at a safe distance below the water surface (e.g. 30-200 meters) to a mooring position close to or at the surface of the water where it can be received by the receptacle and connected to the vessel.

The turret structure itself is connected to the vessel, but is rotatably held within the moonpool of the vessel, allowing the vessel to weathervane under influence of wind, waves and currents. The buoy mooring system may be disconnected and reconnected to the turret structure when needed, thereby providing a disconnectable turret mooring system.

The turret mooring system comprises a fluid transfer system to allow transportation of hydrocarbon fluids, for instance by establishing a flow path between the vessel and a subsea well via the turret structure and the mooring buoy.

The turret structure may comprise a first part of the fluid transfer system and the mooring buoy may comprise a second part of the fluid transfer system. The turret structure comprises fluid paths and a turret manifold and the mooring buoy comprises fluid paths as well which are connected to the risers. The turret structure and mooring buoy fluid paths are matching; conduits of the turret manifold can be connected to corresponding conduits of the buoy to establish one or more hydrocarbon fluid flow path.

During the connection of the mooring buoy to the turret structure, it is important to align both parts of the fluid transfer system to allow proper connection of the fluid transfer system.

This may be done by rotating the turret structure with respect to the vessel before connecting to the mooring buoy. According to state of the art in disconnectable turret mooring systems, the alignment has to be done during a critical phase just before the locking of the mooring buoy into the receptacle of the turret structure.

WO2007/077126 shows an alternative solution. This solution is to connect the mooring buoy without any specific attention as to its orientation. Only after the vessel has safely been connected to the mooring buoy, a turntable which is supported on the turret structure and which is rotating with respect to the turret structure, is rotated to align the turret manifold conduits with the risers that are connected to the buoy when the buoy member is received and locked in the receptacle of the turret structure.

According to another application WO2009/141351 only after the vessel has safely been moored via its turret to the mooring buoy, a turntable, which is supporting the upper turret manifold decks and swivel stacks, is supported with hydraulics which are provided to lift the turntable a few mm so to allow its rotation. Furthermore, a special turntable bearing system and a turntable motor drive system are provided to rotate the turntable in order to align the turret manifold to the buoy manifold.

After alignment, the turntable can be lowered (by a few mm) onto the turret by deactivating the hydraulics. The rotated and aligned turntable and turret structure can be locked together and secured in that position.

The fact that the complete turret manifold can be orientated with regard to the turret structure and the mooring buoy after connection, avoids having to perform the alignment of the turret manifold with respect to the buoy manifold during the critical stage of connecting the buoy member to the turret structure.

However, in these systems, it is requested to operate a heavy mass that generates very high friction torques during rotation and requires a relatively strong, expensive and inaccurate mechanical aligning device.

Different embodiments using turntables are described in US2007155259, U.S. Pat. No. 5,651,708. However, these known mooring systems are relatively complicated and vulnerable for malfunction. For instance, according to WO2009/141351, heavy and complex hydraulics for lifting the turntable, are required.

It is therefore an object of the present invention to provide a turret mooring system that avoids the need of having to perform the alignment of the turret manifold with respect to the buoy manifold during the critical stage of connecting the buoy member to the turret structure, while at the same time, it is not required to provide lifting means that are capable of lifting the full weight of the turret manifold including the structure, the piping, the mechanical equipment, prior to the orientation.

SUMMARY OF THE INVENTION

Hereto, a turret structure for a disconnectable turret mooring system is provided according to claim 1.

Such an embodiment provides the advantage that alignment of the fluid transfer system can be done after the mooring buoy has been locked to the turret structure and the vessel is moored to the seabed via the connected mooring buoy. Alignment is thus done after the critical connection procedure without requiring the rotation of a turntable or the lifting of a turntable.

Furthermore, the intermediate connection member is a stand-alone element supporting the buoy locking system. It allows independent manufacturing and trial fitting on the mooring buoy prior to its integration in the turret structure.

A driving mechanism may be provided to drive the intermediate connection member. The driving mechanism can be relatively small and cheap as it only needs to overcome the maximum resistance torque, especially compared to the relatively heavy lifting means required according to WO2009/141351.

Furthermore, relatively easy fabrication is possible as well as trial fit of the intermediate connection on the buoy can now be done at relatively low costs onshore in a yard or a drydock before integration of the intermediate connection into the turret structure. This way it also reduces or avoids expensive heavy lifting of complex structures as was common in the prior art.

Also, the integration of this structure and its simplified bearing arrangement allow an accurate setting of the concentricity of the turret structure and the mooring buoy with the intermediate connection member that, on known systems, is achieved only through expensive machining. By having the intermediate connection member build separately from the turret structure, possibility is given to trial fit it on top of the mooring buoy and ensure the proper centering of the intermediate connection member and the associated locking system with regards to the mooring buoy. Once the intermediate connection member and the mooring buoy are adjusted, one with regards to the other, the intermediate connection member is placed within the turret structure. By centering the intermediate connection member with regards to the turret structure a proper centering of the mooring buoy with regard to the turret structure is ensured. The intermediate connection member is finally maintained in its centered position for example by intercalating some adjustable shocks or by pouring a polymeric substance or resin at the support bearing pads location.

Another advantage is that the number of buoy locking devices can easily be changed, i.e. only requires replacing the intermediate connection member, without the need to adjust the design of the overall turret structure.

BRIEF DESCRIPTION OF THE DRAWINGS

Embodiments will now be described, by way of example only, with reference to the accompanying schematic drawings in which corresponding reference symbols indicate corresponding parts, and in which.

DETAILED DESCRIPTION

Figure 1A:
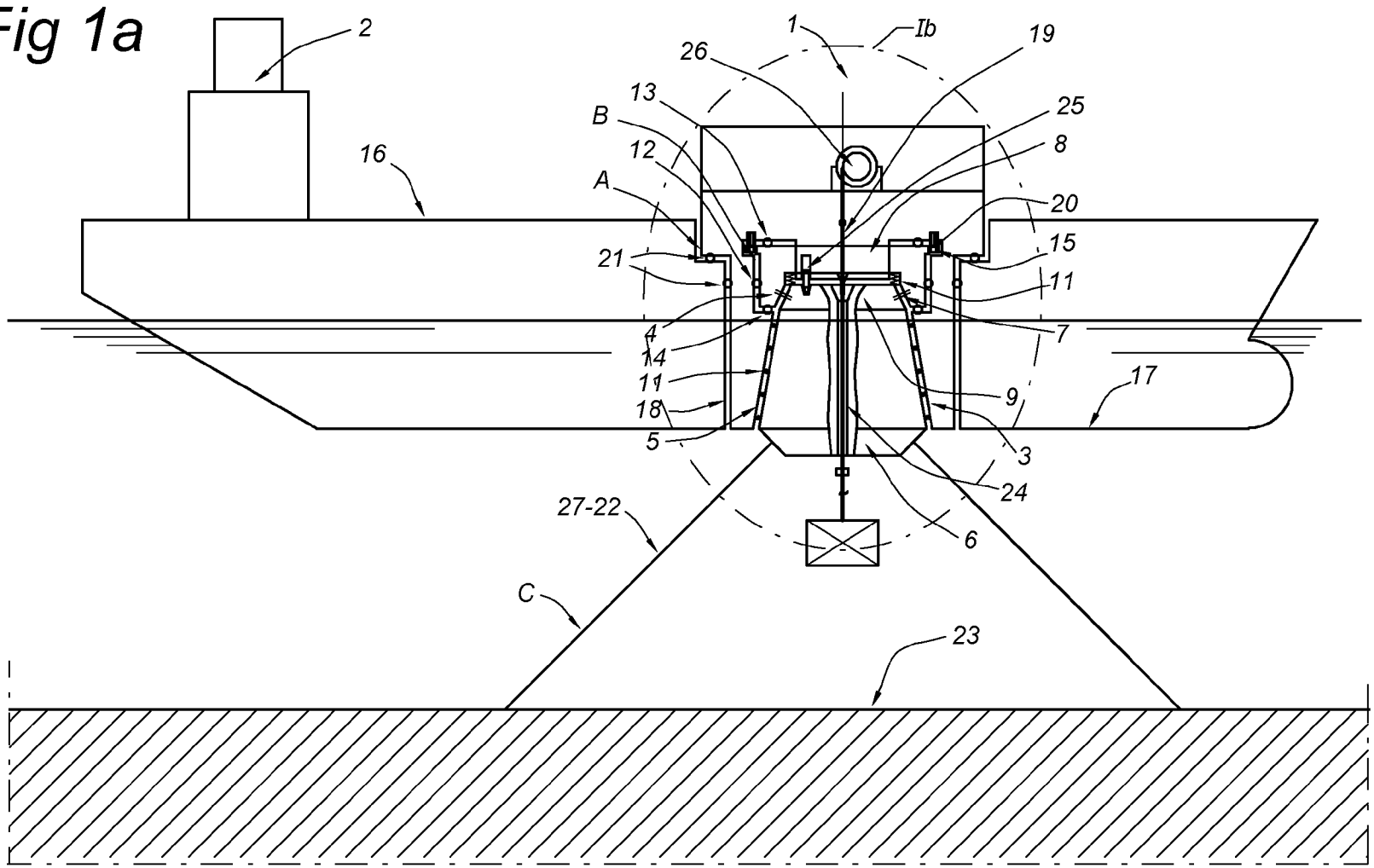
FIG. 1A shows a schematic drawing of a turret mooring system provided on a vessel.
Figure 1B:
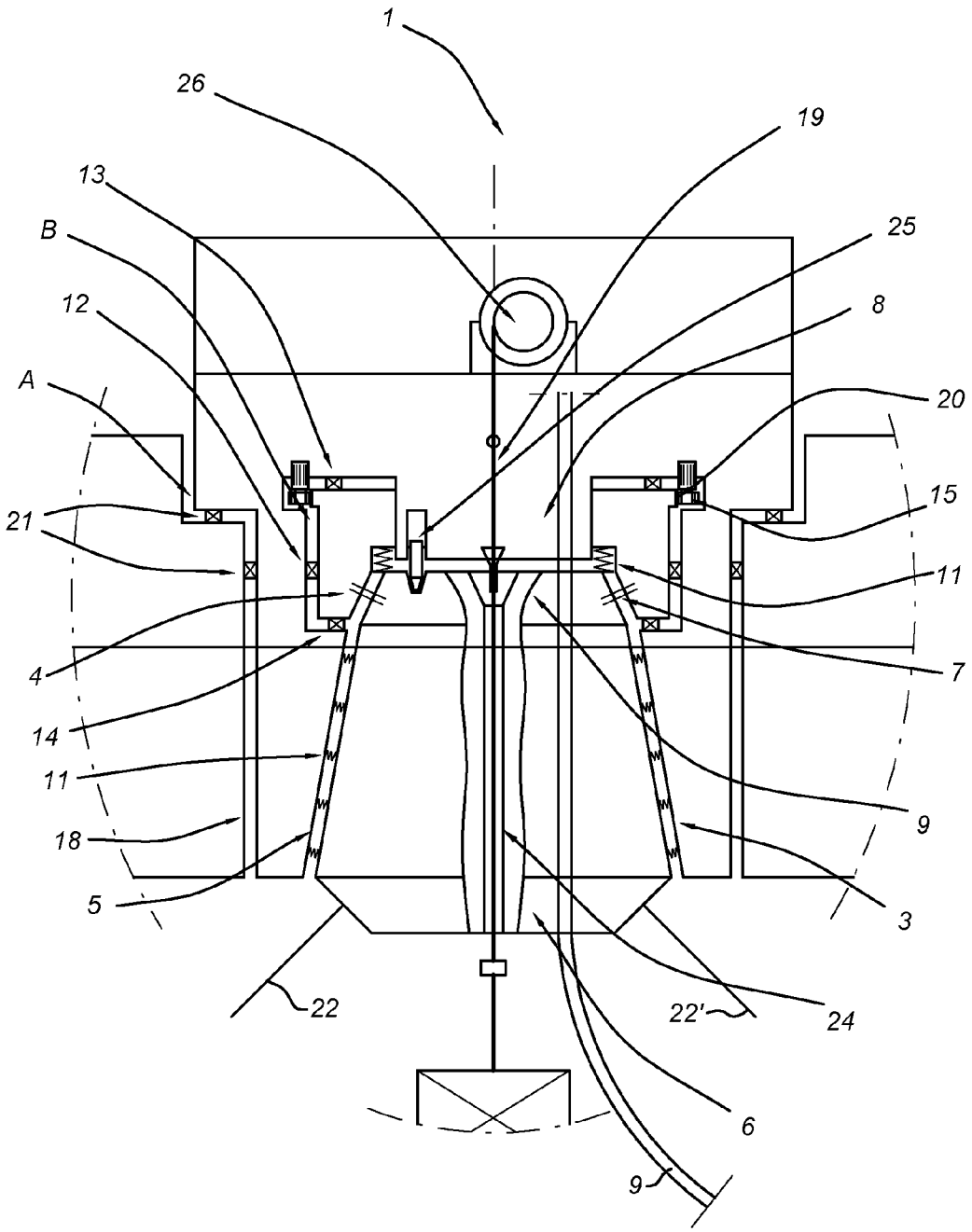
FIG. 1B shows an enlargement of the selected box in FIG. 1A.
Figure 2:
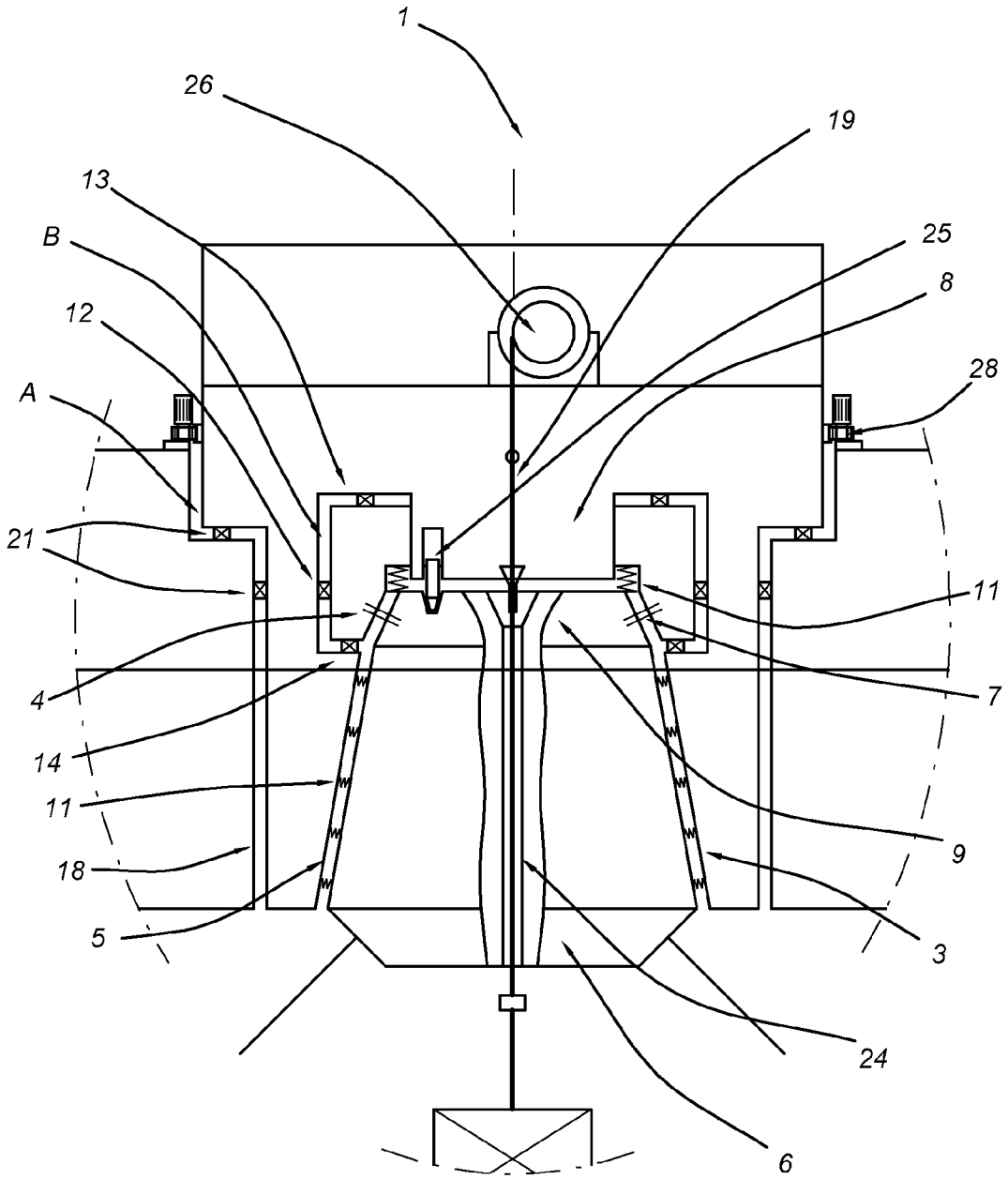
FIG. 2 shows a schematic drawing of another embodiment of the turret mooring system provided on a vessel.

FIGS. 1*a-b* and 2 show schematic drawings of a turret mooring system 1, comprising a mooring buoy and a turret structure provided on a vessel 2, which for example could be a floating production unit (FPU) or floating production storage and offloading (FPSO) unit or floating storage and offloading (FSO) unit. The vessel 2 comprises a hull 16 having a vertical cylindrical opening from deck to the bottom 17 which forms a moonpool 18.

The vessel 2 comprises the turret structure 3, wherein the turret mooring system 1 is rotatably suspended from or supported by the hull 16 of the vessel 2. The turret mooring system 1 comprises the turret structure 3 which is placed within the moonpool 18 and a mooring buoy (6).

A lifting device 26 is placed on one of the decks of the turret structure (3) comprising a cable 19, shown in FIGS. 1*a-b* and 2, that extends through a central shaft 24 provided in the mooring buoy 6 or alternatively, which can be directly coupled to the upper part of the mooring buoy 6 (not shown).

In addition, a turret bearing system 21 connects and aligns the turret structure 3 with respect to the vessel 2. The turret mooring system 1 is as a whole rotationally supported by the vessel 2. The turret mooring system 1 can rotate with respect to the vessel 2 to allow the vessel 2 to weathervane around the turret structure 3 after it is connected mooring buoy 6 or to orientate the turret structure 3 with respect to the mooring buoy 6, without the need to reposition the vessel 2.

In addition, the turret structure 3 comprises an intermediate connection member 4. In an embodiment, the turret structure 3 comprises a receptacle 5 for receiving a mooring buoy 6 but alternatively (not shown) such a receptacle 5 may be omitted.

In an alternative embodiment (not shown), the receptacle 5 could be attached directly to the intermediate connection member 4. The mooring buoy 6 carries an anchoring system 27 which comprises at least one anchoring leg 22 that is connected to a seabed 23. The mooring buoy 6 is receivable in the receptacle 5 for coupling with the turret structure 3.

The intermediate connection member 4 comprises a buoy locking system 7. Many variations of buoy locking systems 7 like multiple hydraulic activated clamps or a central collect connector are known to the skilled person. The buoy locking system 7 is shown schematically in FIGS. 1*a-b* and 2.

The turret structure 3 comprises a turret manifold 8 comprising a fluid transfer pipe that can be connected, after alignment, to a corresponding buoy fluid transfer pipe 9 to establish a fluid flow path between the turret structure 3 and the mooring buoy 6.

The intermediate connection member 4 is rotatably supported by the turret structure 3 and the turret manifold 8, such that the intermediate connection member 4 can be rotated together with the mooring buoy 6 with respect to the turret structure 3, i.e. after locking the mooring buoy 6, so that the fluid piping of the turret manifold piping and the buoy fluid transfer piping can be aligned.

The intermediate connection member 4 is positioned in between the turret structure 3 and the mooring buoy 6 when connected. After disconnecting the mooring buoy 6, the intermediate connection member 4 remains attached to the turret structure 3.

To allow rotation of the intermediate connection member 4 together with the mooring buoy 6, with respect to the turret structure 3, the locking system 7 with at least one buoy locking device is provided on the intermediate connection member 4.

As will be understood by the skilled person, the locking devices may be any known locking device such as the locking devices described in U.S. Pat. No. 5,529,521 or in application WO0189919.

When the mooring buoy 6 enters the receptacle 5, the mooring buoy 6 is guided and pre-centered into the receptacle 5, due to the conical shape and fenders 11 on the inside of the receptacle 5, and due to the pulling force by the reconnection winch cable of the lifting device 26. Once the locking device is activated and lock the mooring buoy 6, the intermediate connection member 4 and the mooring buoy 6 are attached to each other and can rotate together with respect to the turret structure 3 inside the receptacle 5. However, it is also possible that the turret structure 3 is not provided with a receptacle 5, in which case the mooring buoy enters the turret structure 3 directly.

The intermediate connection member 4 and receptacle 5 may further comprise fenders 11 to absorb impact of the mooring buoy 6 when entering the receptacle 5.

Furthermore, in FIGS. 1*a-b* a driving member 15 is provided for rotating the intermediate connection member 4 relative to the turret structure 3. The driving member 15 is provided in between the intermediate connection member 4 and the turret structure 3. The driving member 15 may be any suitable type of motor or mechanical embodiment, arranged to drive a gearing assembly and may comprise a moto-reductor driving mechanism or push/pull jacking system.

The gearing assembly, formed by an annular ring 20 provided along the circumference of the intermediate connection member 4, may comprise a gear wheel or cog wheel that can be rotated by the driving member 15. The gear wheel or cog wheel meshes with a corresponding toothed part of the driving member 15 or with the push/pull jacking system pitch provided on the driving member 15.

The turret structure 3 may further comprise a turret locking system 25, arranged to lock directly the intermediate connection member 4 with the connected mooring buoy 6 with respect to the turret structure 3 after a correct and final alignment of the turret manifold 8 and buoy fluid piping 9 has taken place. The turret locking system 25 may comprise a pin system or can be achieved by securing or blocking the driving member 15 (see below).

After alignment of the fluid piping and the locking of the turret with regard to the intermediate connection member 4 and connected buoy 6, a fluid transfer path can be established between the turret manifold piping and the buoy fluid transfer pipes (including risers that are connected to the buoy).

In FIG. 2 a turret driving system 28 is provided between the vessel 2 and the turret structure 3. The turret driving system 28 may be used to rotate the turret structure 3 with respect to the vessel 2. According to the prior art, such a turret driving system 28 may be used to pre-orientate the turret structure 3 with regard to the mooring buoy 6 before connection.

FIGS. 1 and 2 show that the intermediate connection member 4 is supported by the turret structure 3 by suitable bearings 12, 13, 14.

The bearings may comprise a radial bearing 12, allowing rotational movement of the intermediate connection member 4 with respect to the turret structure 3 and to maintain the intermediate connection member 4 concentric with respect to the turret structure 3.

The bearing may further comprise a lower axial bearing 14 to support the intermediate connection member 4. This axial bearing 14 may be provided in between a downward facing part of the intermediate connection member 4 and an upward facing part of the turret structure 3.

The bearing may comprise a further upper axial bearing 13 to limit uplift of the intermediate connection member 4 during the connection of the mooring buoy 6. Uplift may occur when the mooring buoy 6 enters the receptacle 5 with too high a velocity, for instance due to waves and to the vessel 2 heave motion but also during the reconnection phase when the buoy is pulled by the lifting device 26 against the intermediate connection member 4. Such a further axial bearing 14 may be provided in between an upward facing part of the intermediate connection member 4 and a downward facing part of the turret structure 3.

According to an alternative, the upper axial bearing 13 may be replaced by a structural stopper. This may be done in situations wherein no uplift occurs during the rotation of the intermediate connection member 4 or in situations wherein interruption of the rotation due to uplift is acceptable.

The invention provides a turret mooring system 1 that avoids having to perform the alignment of the buoy pipes 9 with respect to the turret manifold 8 during the connection phase, or at least before locking the mooring buoy 6 in the receptacle 5. The alignment is performed without the use of a turntable and after the critical phase, i.e. after the mooring buoy 6 has been locked to the turret structure 3 via intermediate connection member 4.

Once the mooring buoy 6 is fully pulled within the receptacle 5 of the turret structure 3 and comes in contact with the upper fenders 11, the buoy locking system 7 is activated, i.e. closed, to connect the mooring buoy 6 to the intermediate connection member 4.

The mooring buoy 6 is anchored to the seabed 23 with an anchoring lines 27 having a certain torque resistance (stiffness), giving the mooring buoy 6 some rotational play. The turret structure 3 is connected to the vessel 2 via the turret bearing system 21 and can be locked to the vessel by any suitable means. The turret structure 3 has a torque resistance created by friction of the main turret bearing and fluid swivels (not shown) and indicated by reference A in FIGS. 1*a-b* and 2 with respect to the vessel 2. The intermediate connection member has a relatively small friction based torque resistance with respect to the turret structure 3 which is indicated by reference B (bearings 12, 13, 14) in FIGS. 1*a-b* and 2. The anchoring system 27 has a torque resistance (stiffness) with respect to the sea bed, indicated by reference C in FIGS. 1 and 2.

In order to align the turret manifold 8 and the buoy pipes 9 in the embodiment of FIGS. 1*a-b* after locking the buoy 6 to the intermediate connection member 4, the driving member 15 is actuated to create a moment to rotate the intermediate connection member 4 together with the connected mooring buoy 6 with respect to the turret structure 3 and the vessel 2. During this first phase, the intermediate connection member 4 rotates and the turret structure 3 does not rotate with respect to the vessel 2 due to the friction of the turret bearing system 21. In fact, the driving member 15 is first rotating the intermediate member 4 and connected mooring buoy 6 with regard to the turret structure 3 until the torque resistance of the anchoring system 27 becomes higher than the torque resistance A of the turret bearing system 21.

This point may be reached after a certain rotational angle as the torque resistance of the anchoring legs 27-22 increases when the buoy 6 is rotated. Beyond this point, during the second phase of the rotating alignment procedure, the turret structure 3, suspended from the vessel 2 by the turret bearing system 21, starts to rotate with respect to the vessel 2 and with respect to the combination of the connection member 4 and the mooring buoy 6.

During both phases of the alignment procedure, the intermediate connection member 4 rotates with respect to the turret structure 3 via bearings 12, 13, 14 as the mooring buoy 6 is locked to the intermediate connection member 4. In this way the turret manifold 8 in the turret structure 3 and the buoy pipes 9 are rotated with respect to each other until they are aligned.

If the correct final alignment is reached during the first phase, the rotation is stopped before the second phase is reached. Both fluid piping systems are now aligned and the buoy locking process can be finalized, meaning that the position of the intermediate connector 4 and buoy 6 with regard to the turret structure 3 is fixed and that a fluid path can be established between the turret manifold 8 and the buoy pipes 9.

An alternative alignment procedure according to the embodiment shown FIG. 2 would be to rotate the turret structure 3 and the vessel 2 with respect to each other. For rotating the turret structure 3 a turret driving system 28 is provided between the turret structure 3 and the vessel 2.

In order to align the turret manifold 8 and the buoy pipes 9 after locking the mooring buoy 6 to the intermediate connection member 4, the turret drive system 28 is actuated to rotate the turret structure 3 with respect to the vessel 2. During a first phase the turret structure 3 together with the intermediate connection member 4 and the mooring buoy 6 are rotated with respect to the vessel 2. Due to friction of the bearing of the intermediate connection member 4, the intermediate connection member 4 and connected mooring buoy 6 rotate together with the turret structure 3 with respect to the vessel 2.

When rotating further, the torque resistance C of the anchoring system 27 increases and on a certain point surpasses the friction based torque resistance of the bearing of the intermediate connection member 4; the intermediate connection member 4 with connected mooring buoy 6 does not longer rotate together with the turret structure 3 and the intermediate connection member 4 starts now rotating with respect to the turret structure 3. This point may be reached after a certain rotation angle which depends on the stiffness of the anchoring legs 22. During this second phase of the alignment procedure, the turret manifold 8 and the buoy pipes 9 are rotated with respect to each other and can therefore be aligned.

An advantage of the embodiment described with reference to FIG. 2 is that the turret driving system 28 can also be used to roughly pre-align the turret mooring system with respect to the mooring buoy 6 when the vessel 2 approaches the mooring buoy 6.

After alignment has been completed (but before making a fluid path between the turret manifold and the buoy pipes), the intermediate connection member 4 can be locked to the turret structure 3 to prevent any further rotation. This can be done in case the bearing friction of the intermediate connection member 4 with respect to the turret structure 3 is not high enough to prevent rotation. The locking can be achieved by a suitable turret locking system 25, for instance formed by multiple vertical extendable pins that are mounted on the turret structure 3 and which can be partly moved into corresponding recesses or slots in the intermediate connection member 4 or mooring buoy 6, to directly lock the turret structure 3 and the mooring buoy 6.

It will be understood that it is also possible to provide a turret mooring system comprising a driving member 15 for rotating the intermediate connection member 4 with respect to the turret structure 3 and a turret driving member 28 for rotating the turret structure 3 with respect to the vessel 2, the intermediate connection member 4 as well as the mooring buoy 6.

The descriptions above are intended to be illustrative and not limiting. Thus, it will be apparent to one skilled in the art that modifications may be made to the invention as described without departing from the scope of the claims set out below.

LIST OF PARTS

1. Disconnectable turret mooring system
2. Vessel
3. Turret structure
4. Intermediate connection member
5. Receptacle
6. Mooring buoy
7. Buoy locking system
8. Turret manifold
9. Buoy fluid transfer pipes
10. Locking device
11. Fenders
12. Radial bearing
13. Upper axial bearing
14. Lower axial bearing
15. Driving member
16. Hull
17. Bottom of hull
18. Moon pool
19. Cable
20. Annular ring
21. Turret bearing system
22. Anchoring legs
23. Seabed
24. Central shaft
25. Turret locking system
26. Lifting Device
27. Anchoring System
28. Turret driving system

The invention claimed is:

1. A turret structure (3) for a disconnectable turret mooring system (1) for a vessel, the turret structure (3) to be placed within a moonpool (18) of the vessel and rotatably held within the moonpool via a bearing arrangement, the turret structure (3) being capable of receiving and connecting to a mooring buoy (6) and comprising a buoy locking system (7) for locking the mooring buoy (6) to the turret structure (3), wherein the turret structure comprises an intermediate connection member (4) and the buoy locking system (7) is supported by the intermediate connection member (4) which is rotatably connected to the turret structure (3), and the buoy locking system (7) comprises at least one buoy locking device (10) for locking the mooring buoy (6) to the intermediate connection member (4), the at least one buoy locking device being provided on the intermediate connection member, and a driving member (15) for rotating the intermediate connection member (4) with respect to the turret structure (3).

2. Turret structure according to claim 1, comprising a turret driving member (28) for rotating the turret structure (3) with respect to the vessel (2).

3. Turret structure according to claim 1, wherein bearing members (12, 13, 14) are provided in between the intermediate connection member (4) and the turret structure (3).

4. Turret structure according to claim 3, wherein the bearing members (12, 13, 14) comprise a radial bearing (12) for rotational movement of the intermediate connection member (4) with respect to the turret structure (3).

5. Turret structure according to claim 3, wherein the bearing members (12, 13, 14) comprise at least one axial bearing member (13, 14).

6. Turret structure according to claim 1, wherein the turret structure (3) is provided with a receptacle (5) for receiving the mooring buoy (6).

7. Turret structure according to claim 1, wherein the intermediate connection member (4) comprises fenders (11).

8. Turret structure according to claim 1, wherein the turret mooring system (1) comprises a turret locking system (25), to lock the mooring buoy (6) with respect to the turret structure (3).

9. Turret structure according to claim 1, wherein the turret structure (3) comprises a turret bearing system (21) to rotatably support the turret structure (3) from the vessel (2).

10. Vessel comprising a hull (16) and a turret structure for a disconnectable turret mooring system (1), wherein the turret mooring system (1) is rotatably suspended from the hull (16) of the vessel (2), the turret structure being in accordance with claim 1.

11. Method of mooring a vessel to a mooring buoy (6) using a disconnectable turret mooring system (1), the disconnectable turret mooring system comprising a turret structure (3) with a buoy locking system (7) for locking the mooring buoy (6) to the turret structure (3), wherein the turret structure comprises an intermediate connection member (4) and the buoy locking system (7) is supported by the intermediate connection member (4) which is rotatably connected to the turret structure (3), and the buoy locking system (7) comprises at least one buoy locking device (10) for locking the mooring buoy (6) to the intermediate connection member (4), the at least one buoy locking device being provided on the intermediate connection member the method comprising:

receiving the mooring buoy (6) within the turret structure (3);

locking the mooring buoy (6) to the intermediate connection member (4); and rotating the intermediate connection member (4) and the turret structure (3) with respect to each other, wherein rotating the intermediate connection member (4) and the turret structure (3) with respect to each other is performed by a driving member (15) provided in between the turret structure (3) and the intermediate connection member (4).

12. Method according to claim 11, wherein rotating the intermediate connection member (4) and the turret structure (3) with respect to each other is performed by a turret driving system (28) provided between the turret structure (3) and the vessel (2).

13. Method according to claim 12, wherein rotating the intermediate connection member (4) and the turret structure (3) with respect to each other comprises a first phase wherein the turret structure (3) together with the intermediate connection member (4) and the mooring buoy (6) rotate with respect to the vessel (2), and a second phase wherein the turret structure (3) rotates with respect to the vessel (2), the intermediate connection member (4) and the mooring buoy (6).

14. Method according to claim 11, comprising the step of locking the mooring buoy (6) and the intermediate connection member (4) with respect to the turret structure (3).

15. Method according to claim 11, comprising establishing a flow path between the turret structure (3) and the mooring buoy (6) via a turret manifold (8) and buoy pipes (9).

16. Method according to claim 11 Method of mooring a vessel to a mooring buoy (6) using a disconnectable turret mooring system (1), the disconnectable turret mooring system comprising a turret structure (3) with a buoy locking system (7) for locking the mooring buoy (6) to the turret structure (3), wherein the turret structure comprises an intermediate connection member (4) and the buoy locking system (7) is supported by the intermediate connection member (4) which is rotatably connected to the turret structure (3), and the buoy locking system (7) comprises at least one buoy locking device (10) for locking the mooring buoy (6) to the intermediate connection member (4), the at least one buoy locking device being provided on the intermediate connection member the method comprising:

receiving the mooring buoy (6) within the turret structure (3);

locking the mooring buoy (6) to the intermediate connection member (4); and rotating the intermediate connection member (4) and the turret structure (3) with respect to each other, wherein rotating the intermediate connection member (4) and the turret structure (3) with respect to each other comprises a first phase wherein the intermediate connection member (4) rotates and the turret structure (3) remains still with respect to the vessel (2), and a second phase wherein the intermediate connection member (4) remains still and the turret structure (3) rotates with respect to the vessel (2).

* * * * *